United States Patent [19]

Tanaka et al.

[11] Patent Number: 4,576,558

[45] Date of Patent: Mar. 18, 1986

[54] SCREW ROTOR ASSEMBLY

[75] Inventors: Masanori Tanaka, Niigata; Atsushi Maehara, Bunsuimachi; Junichi Kanai, Yoshidamachi, all of Japan

[73] Assignee: Hokuetsu Industries Co., Ltd., Niigata, Japan

[21] Appl. No.: 714,540

[22] Filed: Mar. 21, 1985

[30] Foreign Application Priority Data

Apr. 7, 1984 [JP] Japan ..... 59-69699

[51] Int. Cl.[4] ..... F01C 1/16

[52] U.S. Cl. ..... 418/150; 418/201

[58] Field of Search ..... 418/150, 201

[56] References Cited

U.S. PATENT DOCUMENTS

| | | | |
|---|---|---|---|
| 3,423,017 | 1/1969 | Schibbye | 418/201 |
| 3,787,154 | 1/1974 | Edstrom | 418/201 |
| 4,088,427 | 5/1978 | Emanuelsson | 418/201 |
| 4,412,796 | 11/1983 | Bowman | 418/201 |
| 4,492,546 | 1/1985 | Kasuya | 418/201 |
| 4,508,496 | 4/1985 | Bowman | 418/201 |

FOREIGN PATENT DOCUMENTS 54-25552 8/1979 Japan .

*Primary Examiner*—Leonard E. Smith
*Assistant Examiner*—Jane E. Obee
*Attorney, Agent, or Firm*—Oblon, Fisher, Spivak, McClelland & Maier

[57] ABSTRACT

A screw rotor assembly having nonsymmetrical tooth profiles and used in a screw-type rotary compressor or expander. The tooth profile of the female rotor is formed such that a line ($H_2$-$A_2$) is formed by a generated curve of a point $A_1$ of the male rotor; a line ($A_2$-$B_2$) is formed by a circular arc having a point $O_7$ as the center of the arc and a radius $R_7$; a curve ($B_2$-$C'_2$) is formed by an envelope developed by a circular arc ($B_1$-$C_1$) of the male rotor; a portion between points $D'_2$ and $E_2$ is formed by a circular arc having a point $O_1$ as the center of the arc and a radius $R_1$; a line (C'-D') is formed by a line smoothly connecting the curves ($B_2$-$C'_2$) and ($D'_2$-$E_2$); a curve ($E_2$-$F_2$) is formed by a circular arc having a point $O_2$ as the center of the arc and a radius $R_2$; and a curve ($F_2$-$G_2$) is formed by a circular arc having a point $O_8$ as the center of the arc and a radius $R_8$. The tooth profile of the male rotor is formed such that a curve ($H_1$-$A_1$) is formed by a generated curve of a point $H_2$ of the female rotor; a curve ($A_1$-$B_1$) is formed by an envelope developed by the arc ($A_2$-$B_2$) of the female rotor; a curve ($B_1$-$C_1$) is formed by a circular arc having a point $O_4$ as the center of the arc and a radius $R_4$; a curve ($C_1$-$D_1$) is formed by a circular arc having the rotating center of the male rotor as the center of the arc and a radius $R_5$; and curves ($D_1$-$E_1$), ($E_1$-$F_1$) and ($F_1$-$G_1$) are generated by arcs ($D_2$-$E_2$), ($E_2$-$F_2$) and ($F_2$-$G_2$) of the female rotor tooth profile, respectively. The screw rotor assembly prevents abnormal noise and vibration of the compressor or expander and can be easily manufactured.

1 Claim, 19 Drawing Figures

SCREW ROTOR ASSEMBLY

BACKGROUND OF THE INVENTION

1. Field of the Invention

The present invention relates to a pair of screw rotors used in a screw rotor machine for compressing or expanding a compressible fluid and supplying the compressed or expanded fluid and, more particularly, to a tooth profile curve thereof.

2. Discussion of the Background

Rotors having nonsymmetrical tooth profiles and used in a compressor or the like of a compressible fluid generally comprise a male rotor having helical lands with a major portion of each tooth profile outside the pitch circle thereof, and a female rotor having helical grooves with a major portion of each tooth profile inside the pitch circle thereof. Normally, the male rotor has a plurality of teeth, and the female rotor meshing therewith has a number of teeth slightly exceeding the number of teeth of the male rotor. The diameter of the tip circle of the male rotor is set to be substantially the same as that of the pitch circle of the female rotor.

A screw compressor or expander is constructed as follows. A pair of screw rotors of this type are rotatably housed inside a working space comprising two cylindrical bores formed in a casing. The cylindrical bores have parallel axes and have diameters equal to the outer diameter of the respective rotors to be arranged therein. The distance between the axes of the cylinders is shorter than the sum of the radii thereof, and the axial length of each cylindrical bore is the same as that of the rotors. The two end portions of the cylindrical bores are closed with end plates fixed to the casing. Inlet and outlet ports for the fluid are formed at predetermined positions of the casing (FIG. 3(*a*) or 3(*b*)).

When the above assembly is used as a compressor, the female rotor is rotated counterclockwise while the male rotor is rotated clockwise. With respect to the concave tooth profile of the groove of the female rotor, a curve at the front side along the rotating direction is referred to as the leading side tooth profile, and that at the rear side along the rotating direction is referred to as the trailing side tooth profile. Similarly, with respect to the convex tooth profile of the land of the male rotor, that at the front side along the rotating direction is referred to as the leading side tooth profile, and that at the rear side along the rotating direction is referred to as the trailing side tooth profile.

When the above assembly is used as an expander, the names of the respective curves are reversed. However, in the description to follow, the respective tooth profile curves will be explained in accordance with the above definitions.

FIGS. 1(*a*) and 1(*b*) show the respective tooth profile curves when the rotors are cut along a plane perpendicular to their rotating axes, i.e., the meshing state between the screw rotors at the end face of each rotor along the longitudinal axes thereof. FIG. 1(*a*) shows the phases of the tooth profiles of the two rotors immediately after the trailing side tooth profile curves of the male and female rotors have begun to contact each other. When the male rotor is rotated through about 20° thereafter, the phases as shown in FIG. 1(*b*) are obtained wherein the highest portion of the tooth profile of the male rotor opposes the deepest portion of the groove of the tooth profile of the female rotor.

The above tooth profiles are conventional ones which are used in, for example, screw compressor manufactured by Hokuetsu Industries Co., Ltd. (Japanese Utility Model Registration No. 1432776) and have the following characteristics.

Referring to FIGS. 1(*a*) and 1(*b*), reference numeral 1 denotes a male rotor; and 2 a female rotor meshed therewith. The rotors 1 and 2 rotate about centers of rotation 3 and 4 (centers of the pitch circles) inside cylindrical bores of a casing (not shown) in the direction indicated by arrows, respectively, so as to serve as a fluid compressor. Reference numerals 15 and 16 respectively denote pitch circles of male rotor 1 and female rotor 2. A line connecting the centers of rotation 3 and 4 passes a contact point 17 between the pitch circles 15 and 16, i.e., a pitch point 17.

The above-mentioned tooth profiles will be described with reference to FIG. 1(*b*).

(1) Female Rotor Tooth Profile (i) Leading side curve: The leading side curve is formed such that it consists of a circular arc (11-12) which extends from a point 12 at the deepest tooth profile portion of the groove of the female rotor to an outermost end 10 of the tooth profile and has a radius $r_4$ with respect to the pitch point 17 which is the center of the arc (11-12), the portion between points 11 and 10 and extending from the arc (11-12) is a straight line (10-11) passing through the rotating center 4 of the female rotor and being circumscribed the arc (11-12) having the radius $r_4$, the curve between points 12 and 13 of the bottom land of the groove of the female rotor is a circular arc (12-13) which has a radius $r_2$ with the rotating center 4 of the female rotor as the center of the arc, and a portion between points 10 and 14 on the outer diameter of the tip circle coincides with the pitch circle 16 of the female rotor.

(ii) Trailing side curve: The trailing side curve is formed such that the curve between points 13 and 14 at the trailing side of the groove of the female rotor is set as an epitrochoidal curve generated by a point 8 on the tooth profile of the male rotor.

(2) Male Rotor Tooth Profile (i) Leading side curve: The leading side curve is formed such that a curve (7-6) from a tip 7 of the male rotor tooth profile to a point 6 toward a point 5 at an innermost portion of the male rotor tooth profile is a circular arc with the contact point (pitch point) 17 between the pitch circles 15 and 16 of the two rotors serving as the center of the arc and has a radius $r_3$ which is smaller than the radius $r_4$ by an amount required for rotation, and a curve (6-5) from the point 6 to the innermost portion 5 is an envelope which is developed by a line between points 10 and 11 of the female rotor.

(ii) Trailing side curve: The trailing side curve is formed such that a curve between points 7 and 8 at the trailing side of the male rotor tooth profile is a circular arc which has a radius $r_1$ with the rotating center 3 of the pitch circle 15 of the male rotor as the center of the arc, a curve (8-9) between a point 8 and a point 9 at an innermost portion of the male rotor tooth profile is an epicycloidal curve generated by a point 14 at the outermost portion of the groove of the female rotor, a curve between points 9 and 5 of the bottom of the groove coincides with the pitch circle 15 of the male rotor, and the point 8 reaches the intersection, on the sealing line along the thread ridge, which is at the sealed side of the cylindrical bores of the working space of the compressor. The point 8 is determined to be distant from a line (X-axis) connecting the centers of rotation 3 and 4 of the two rotors.

Since the conventional tooth profiles shown in FIG. 1(*b*) are defined as described above have following advantages, (i) The blo hole between the working spaces can be set at substantially 0.

(ii) In the tooth profiles shown in FIG. 1(*b*), since the point 8 of the male rotor tooth profile is determined to be distant from the X-axis, the ratio of volume expansion of a space 18 defined at the contact portion between the tooth profiles of the male and female rotors upon rotation of the rotors is smaller than that obtained with the SRM tooth profiles (to be described later). Therefore, the power loss due to a vacuum produced in the space 18 upon volume expansion is small.

Despite these advantages, the conventional tooth profiles have the following disadvantages:

(iii) The volume of the working space is small (the stroke volume is small).

(iv) Since the bottom of the groove of the female rotor tooth profile has projections and recesses, a complete seal cannot be provided. The size measurement is difficult to obtain during machining. The cutter profile for machining the rotor also has projections and recesses and is complex and is inefficient in machining.

(v) Since the trailing side tooth profile curve is point-generated, the seal point wears easily and the sealing effect cannot be maintained over a long period of time.

(iv). Since the pressure angle of the tooth profile near the pitch circle is substantially 0, precise machining is difficult and the life of the machining tool is also short. The life of a hob tool is particularly short when screw rotors are hobbed.

A contact surface 18' in the initial meshing phases of the tooth profiles shown in FIG. 1(*a*) forms a space 18 in the phases shown in FIG. 1(*b*) in which the rotor 1 has rotated through about 20° from the state shown in FIG. 1(*a*). Thus, the space 18 is exposed to vacuum by expanding and causes a power loss regardless of compression operation. For this reason, it is preferable to reduce the volume of trapped space 18. The tooth profile with the characteristics described above has a smaller ratio of volume expansion of the space 18 as compared to one to be described below.

For example, in one type of conventional tooth profile called the SRM tooth profile, the rotor used in a screw rotor machine as described in U.S. Pat. No. 3,423,017 has the tooth profile as shown in FIG. 2. The same reference appear in FIGS. 1(*a*) and 1(*b*) denote the same parts in FIG. 2, and a detailed description thereof will thus be omitted. The meshing phases in FIG. 2 correspond to those in FIGS. 1(*a*) and 1(*b*). Referring to FIG. 2, (1) Female Rotor Tooth Profile (i) Leading side curve: line (28-29); a circular arc having a point 36 on a straight line (17-29) as the center of the arc and a radius $r'_1$, and a circular arc (29-30) having a pitch point 17 as the center of the arc and a radius $r'_2$.

(ii) Trailing side curve: curve (30-31); an epitrochoidal curve generated by a point 23 on the male rotor tooth profile, line (31-32); a part of a curve passing through the center of rotation 4 of the male rotor, curve (32-33); a circular arc having the center of the arc on the pitch circle 16, curve (33-34); a circular arc having the center of rotation 4 as the center of the arc, and line (34-35); a circular arc having the center of the arc on the pitch circle 16.

(2) Male Rotor Tooth Profile (i) Leading side curve: curve (21-22); an envelope developed by the arc (28-29) of the female rotor tooth profile, curve (22-23); a circular arc having the pitch point 17 as the center of the arc and a radius $r'_2$.

(ii) Trailing side curve: curve (23-24); an epitrochoidal curve generated by a point 31 on the female rotor tooth profile, curve (24-25); a curve generated by a curve (31-32), curve (25-26); a circular arc having the center of the arc on the pitch circle 15, curve (26-27); a circular arc having the center of rotation 3 as the center of the arc, and line (27-21); an arc having the center on the pitch circle 15.

The volume of the space 18 in the SRM tooth profile which is to be exposed to vacuum is significantly larger than that in the tooth profile shown in FIG. 1(*b*).

When both the male and female rotors are at the rotating positions shown in FIG. 2(*a*), they contact at three points 31, 30 and 69 so that the compressed fluid will not leak. Due to the presence of these three contact points, a space 73 is formed at the leading side (upper side from the X-axis in FIG. 2(*a*)) of the male rotor, while a similar space 18 is formed at the trailing side (lower side from the X-axis in FIG. 2(*a*)) of the male rotor. Assume that the space 18 is sealed by an end face 67 (FIG. 3(*a*)) at the inlet side ends of the rotors, and the male and female rotors continue to rotate in the direction indicated by the arrow in FIG. 2(*a*). Then, the volume of the space 18 is gradually increased, and the degree of vacuum inside the space 18 (to be referred to as a vacuum space) is increased. As compared to the tooth profile shown in FIG. 1(*b*), the size of the vacuum space is significantly larger. As for an end face 68 (FIG. 3(*a*)) at the outlet side ends of the rotors, immediately before the space 73 opens into the end face 68, such gradually decreases in volume as the two rotors rotate and finally becomes substantially zero. Therefore, the gas trapped in the space 73 is compressed to an abnormal pressure. In a hydraulically-cooled rotary compressor, the lubricating fluid is injected into the working space for lubricating and cooling the contact and bearing portions. Therefore, the lubricating fluid being trapped inside the space 73 receives compression. As a result, as the rotors rotate, abnormal vibration or noise is generated and, in a worst case, the rotors wear or are damaged. In addition, a large drive torque is required for driving the compressor. Then, since an immoderate load is exerted on the rotors and the casing, a power loss is large and the life of bearings of the rotor shafts is shortened.

In order to solve this problem, Japanese Patent Application Laid Open Gazette Nos. 58-214693 and 58-131388 propose means for preventing overcompression of a residual gas by forming a bypass hole 71 in a casing inner wall surface 70 at the outlet port side as shown in FIG. 2(*b*), so that the residual gas and lubricating fluid are evacuated into another low-pressure working space through this bypass hole 71, or by forming a recess with a large volume at the position of the bypass hole 71. However, these means render the structure of the compressor complex and expensive, and lowers the performance.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

SUMMARY OF THE INVENTION

Figure 1A:
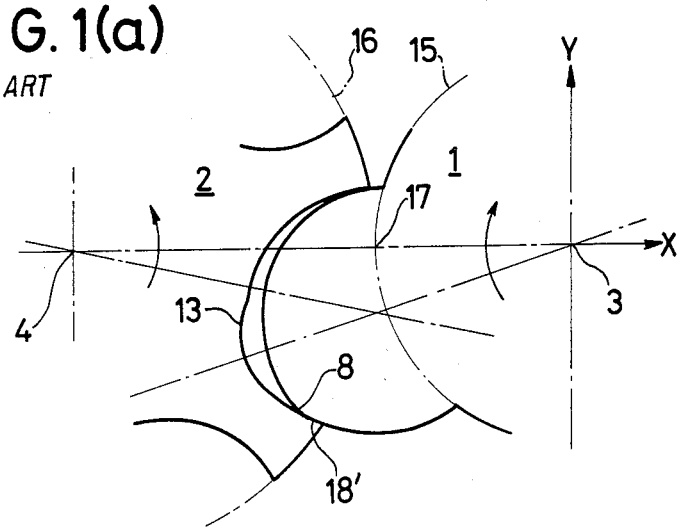
FIG. 1(a) PRIOR ART
FIGS. 1(*a*), 1(*b*) and 2(*a*) show tooth profile curves of conventional screw rotors, in which FIGS. 1(*a*) and 1(*b*) correspond to different phases of the tooth profiles disclosed in Japanese Utility Model Registration No. 1432776 as time elapses from FIG. 1(*a*) to FIG. 1(*b*)
Figure 1B:
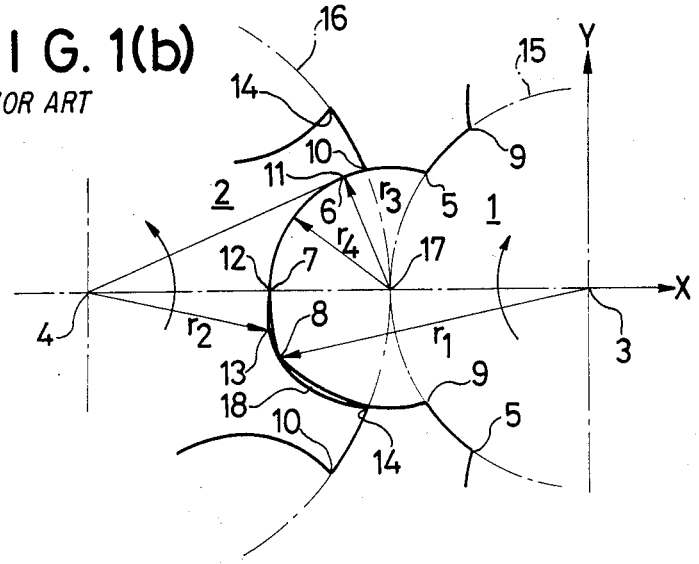
FIG. 1(b) PRIOR ART

It is, therefore, an object of the present invention to provide novel tooth profiles which will not impair the advantages of the tooth profiles shown in FIG. 1 previously proposed by said Japanese Utility Model Registration No. 1432776; and which reduces the disadvantages of these tooth profiles, i.e., increases the stroke volume, prevents rotor wear by changing portions of tooth profiles which form the sealing points for maintaining superior efficiency over a long period of time, increases the pressure angle for improving the machining precision of the tooth profile and increases the tool life, and facilitates easy formation of tools.

DESCRIPTION OF THE PREFERRED EMBODIMENTS

The tooth profiles according to a preferred embodiment of the present invention will now be described with reference to the accompanying drawings.

Figure 3A:
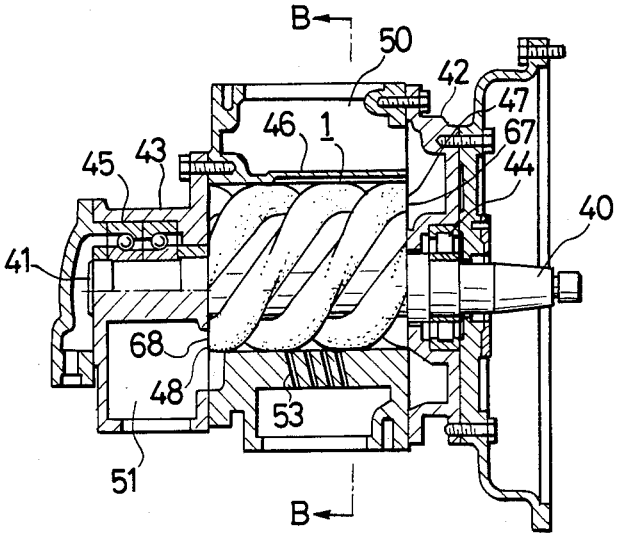
FIGS. 3(*a*) and 3(*b*) are a side sectional view and a cross-sectional view of a rotor machine or a compressor using the screw rotor assembly according to the present invention.
Figure 3B:
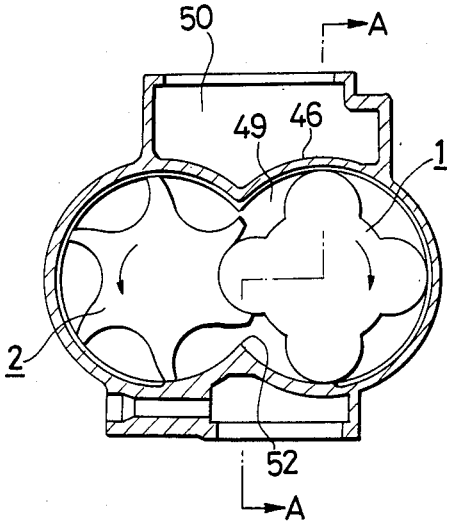
Figure 4A:
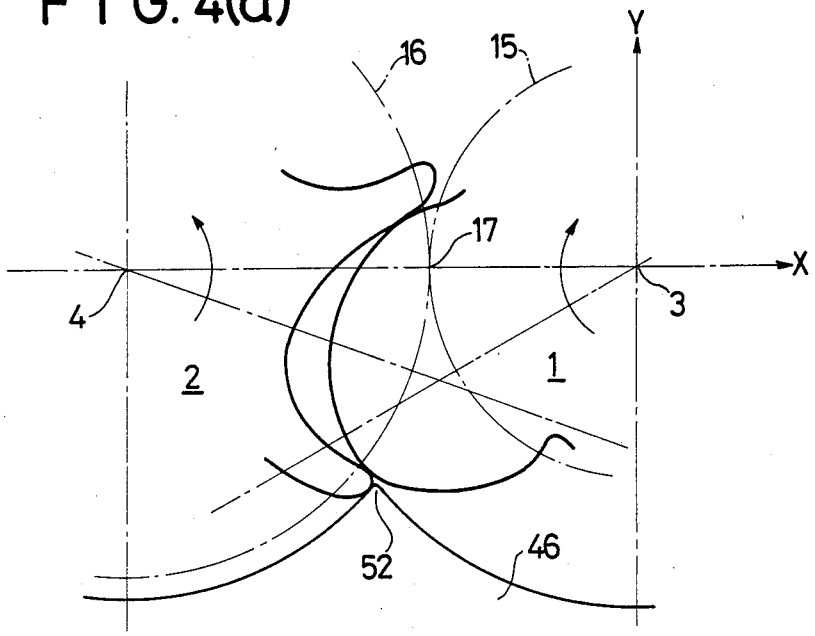
FIG. 4(*a*) to FIG. 4(*d*) show the different meshing positions of a pair of tooth profile curves of the screw rotors of the present invention, in which the meshing phase shown in FIG. 4(*a*) is shifted with respect to that shown in FIG. 4(*b*) and then to that shown in FIG. 4(*c*), and FIG. 4(*d*) is an enlarged view of FIG. 4(*c*)
Figure 4B:
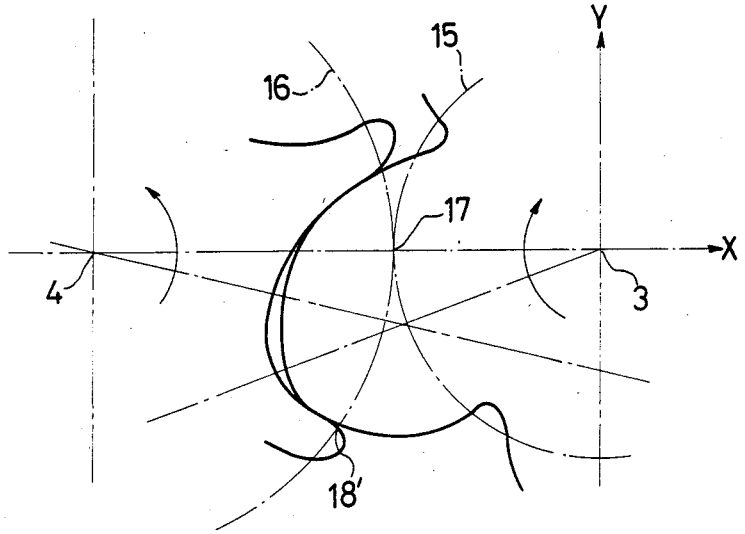
Figure 4C:
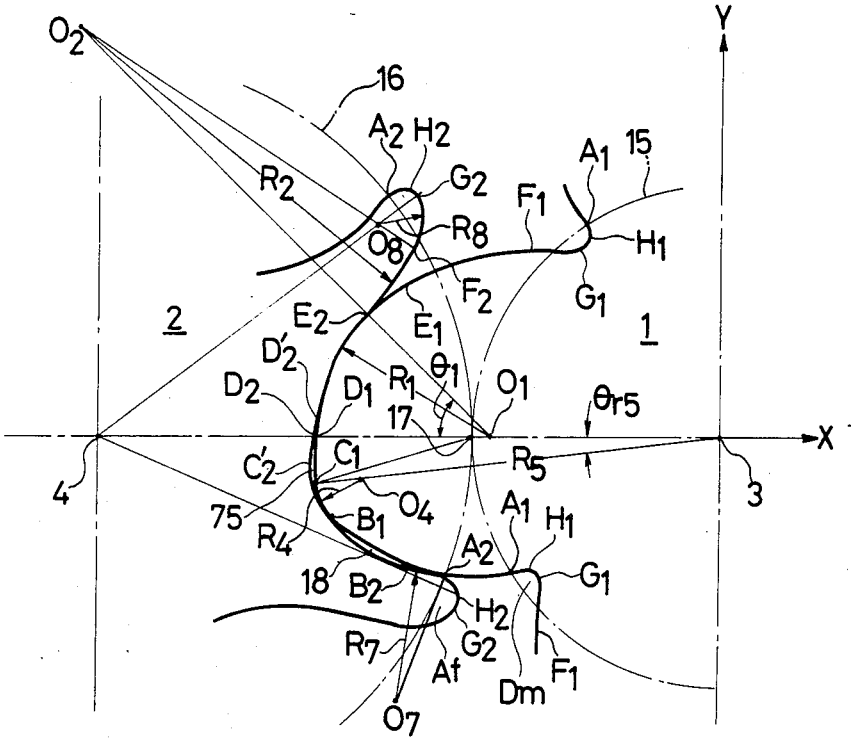

FIGS. 3(*a*) and 3(*b*) show a compressor of a compressible fluid having a screw rotor assembly according to the present invention assembled therein. FIG. 3(*a*) is a side sectional view along the line A—A in FIG. 3(*b*), and FIG. 3(*b*) is a cross-sectional view along a line B—B in FIG. 3(*a*). Referring to FIGS. 3(*a*) and 3(*b*), reference numeral 1 denotes a male rotor which is driven by a rotating shaft 40 coupled to a prime mover (not shown) and rotatably supported by bearings 44 and 45 mounted on end plates 42 and 43 by the rotating shaft 40 and a support shaft 41 extending symmetrically and coaxially with the rotating shaft 40 with respect to the rotor 1. Reference numeral 2 denotes a female rotor meshing with the male rotor 1. The rotor 2 is rotatably supported by the end plates 42 and 43 by supporting shafts extending coaxially with the female rotor 2. Reference numeral 46 denotes a casing surrounding the outer circumferences of the meshing rotors 1 and 2. The low-pressure side end plate 42 having an inlet port 47 and the high-pressure side end plate 43 having an outlet port 48 are coupled at the end faces of the casing 46 along its axial direction. A working space 49 is defined by the teeth of the rotors, surfaces of grooves, inner surface of the casing and inner walls of the end plates. The working space 49 communicates the inlet port 47 and the outlet port 48 which respectively communicate with a low-pressure path 50 and a high-pressure path 51 for the working fluid formed in the casing 46. The sectional area of the working space 49 corresponds to a combined area of two parallel cylindrical spaces, the distance between the central axes of the two cylinders is smaller than the sum of the radii of the respective cylinders; the two cylinders have an overlapping portion and therefore have ridge lines 52 at which the inner walls thereof intersect as well shown in FIG. 3(*b*).

The female rotor 2 is provided with six helical grooves with a wrap angle of about 200° along the rotating axis (longitudinal axis) of the rotor 2. Major portions of the grooves are located inside the pitch circles of the rotor 2. The height of each tooth between adjacent grooves is slightly larger than the pitch circumference, and the profile of the grooves have inwardly concave curves.

The male rotor 1 is provided generally with four helical lands or teeth having a wrap angle of about 300° along the rotating axis (longitudinal axis) of the rotor 1. Each tooth has two flanks provided with a generally convex profile, the major portion thereof is located outside the pitch circle and the remainder thereof is located inside the pitch circle. Each two adjacent teeth define a groove for receiving a tooth of the rotor 2 between said flanks. The working space 49 has a V-shape. Upon rotation of the rotors, communication between the inlet port 47 of the low-pressure side end plate 42 and the working space 49 is shielded. Thereafter, as the meshing line (sealing line) of the tooth profiles of the two rotors shifts (relative to the rotation of the rotors), the volume of the working space 49 is reduced to that before being completely sealed. During this time, the fluid is adiabatically compressed and increased in pressure and temperature. When the working space communicates with the outlet port 48 formed in the high-pressure end plate 43, such supplies the compressed fluid to the side of the high-pressure path 51.

During this time, the cooled lubricating fluid is injected into the working space through a nozzle 53 in order to lubricate meshing between the rotor teeth and groove surfaces, the sliding surfaces between the inner wall of the casing and radial end surfaces of the teeth of rotors, and between axial end faces of the rotors and inner side surfaces of the end plates, to seal the working space and to prevent a temperature increase due to the compression of the fluid.

The present invention relates to tooth profiles of the rotors of the compressor for a compressible fluid.

FIGS. 4(*a*), 4(*b*) and 4(*c*) show tooth profiles when the screw rotors of the present invention are cut along a plane perpendicular to the rotating axes. Referring to FIGS. 4(*a*), 4(*b*) and 4(*c*), reference numeral 1 denotes a male rotor; and 3 a center of rotation of the male rotor 1, i.e., the center of a pitch circle 15 of the male rotor tooth profile. The male rotor 1 meshes with a female rotor 2 and rotates about the center 3 in the direction indicated by an arrow. Reference numeral 2 denotes a female rotor; and 4 a center of rotation thereof, i.e., the center of a pitch circle 16 of the female rotor tooth profile. The rotor 2 meshes with the male rotor 1 and rotates about the rotating center 4 in the direction indicated by an arrow. Reference numeral 17 denotes a pitch point. Center 3, pitch point 17 and center 4 are located on a straight line. The pitch circles 15 and 16 circumscribe each other at point 17. Reference numeral 18 denotes a vacuum space (vacuum producing space) formed between tooth profiles of rotors 1 and 2. FIG. 4(*a*) shows a phase immediately before the teeth and grooves of the two rotors start to mesh, and illustrates the blow hole formed between the teeth and inner wall of the casing. FIG. 4(*b*) shows a phase wherein the rotor 1 has rotated through about 10° from the phase shown in FIG. 4(*a*) and the rotors contact at point 18' (upstream side along the rotating direction). FIG. 4(*c*) shows a phase wherein the male rotor has rotated through another 20° and the tooth profiles mesh completely with each other. FIG. 4(*d*) is an enlarged view of the bottom of the groove of the female rotor and the tip of the male rotor. The following description of the tooth profiles will be made with refernce to FIGS. 4(*c*) and 4(*d*). Referring to FIGS. 4(*c*) to 4(*d*), the tooth profiles are set under the following conditions. Note that symbol Af denotes an addendum; and Dm, a dedendum. Point $A_1$ located on the tooth profile is also a point on the pitch circle 15; and point $A_2$ located on the tooth profile is also a point on the pitch circle 16.

(1) Female Rotor Tooth Profile (i) Trailing side curve: from the outermost point toward the bottom of the groove, (a) curve ($H_2$-$A_2$); a curve generated by the point $A_1$ which is located on the male rotor tooth profile at a point where the profile intersects with the pitch circle 15 and circumscribe curve ($A_2$-$B_2$) at the point $A_2$ located on the pitch circle 16 of the female rotor 2.

(b) curve ($A_2$-$B_2$); a circular arc having a radius $R_7$ with a center of the arc $O_7$ located on a straight line circumscribing the pitch circle 16 at the point $A_2$ and outside the concave of the groove.

(c) curve ($B_2$-$C_2$); an envelope developed by an arc ($B_1$-$C_1$) which is a part of the male rotor tooth profile and tangentially connected with the curve ($A_2$-$B_2$) at a point $B_2$.

(d) curve ($C'_2$-$D'_2$); a common tangent of an envelope ($B_2$-$C'_2$) developed by the arc ($B_1$-$C_1$) which is a part of the male rotor tooth profile (an extension thereof intersects with the curve (3-4) at a point $C_2$), and a circular arc ($D'_2$-$E_1$) having a radius $R_1$ and a center of the arc $O_1$ on the curve (3-4) and outside the pitch circle 16. This curve ($C'_2$-$D'_2$) can be a smooth curve similar to a circular arc having a radius $R_5$.

(iii) Leading side curve: from the straight line (3-4) toward an outermost point, (e) curve ($D'_2$-$E_2$); a circular arc having a radius $R_1$ and a center of the arc $O_1$ located on the line (3-4) and outside the pitch circle 16. The arc connects with a curve ($E_2$-$F_2$) at a point $E_2$. One extension of the arc ($D'_2$-$E_2$) intersects the line (3-4) at a point $D_2$.

(f) curve ($E_2$-$F_2$); a circular arc having a radius $R_2$ and a center of the arc $O_2$ located opposite the point $O_1$ on an extension of straight line ($O_1$-$E_2$) which is intersecting the line (3-4) with an angle $\theta_1$ between the line (3-4) at the point $O_1$ located outside the pitch circle 16 of the female rotor. The arc is convex toward the male rotor and connects with a curve ($F_2$-$G_2$) at a point $F_2$.

The angle $\theta_1$ is 40° to 55° and satisfies an inequality $1.05 \leqq (R_1/(R_5-PCR) \leqq 1.3$. Note that PCR is the pitch circle radius of the male rotor.

Figure 8:
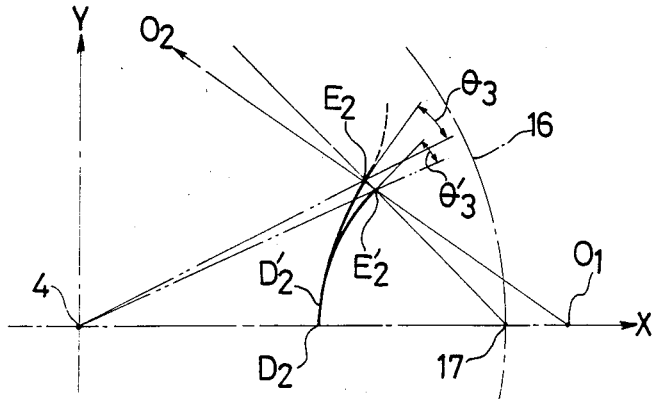
Figure 9:
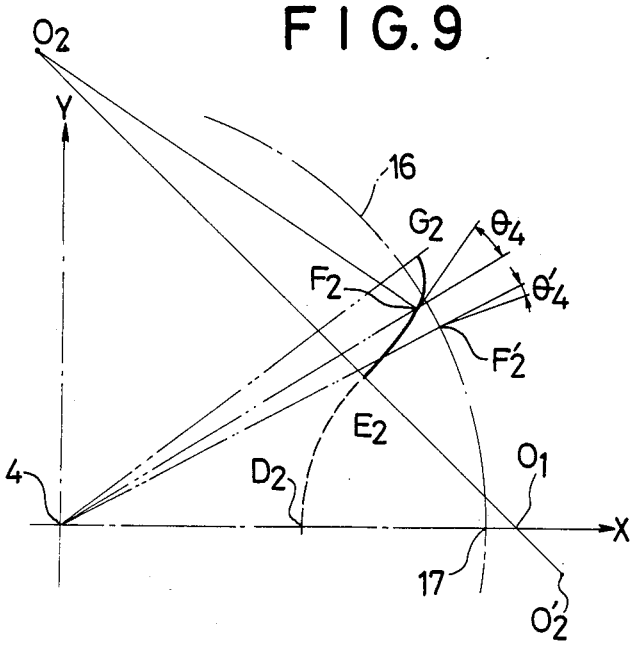

The larger the value of $R_1/(R_5-PCR)$ than 1 and the smaller the value of the angle $\theta_1$, the larger the pressure angle near the pitch circle of the tooth profile constituting the curve ($C_2$-$E_2$) can be established (see FIGS. 8 and 9). The closer the value of $R_1/(R_5-PCR)$ to 1 and the larger the value of the angle $\theta_1$, the larger the thickness of the tooth of the female rotor can be established.

In this embodiment, the pressure angle can be set to be sufficiently large, and the above ranges of $R_1$ and $\theta_1$ are set for assuring a tooth thickness with satisfactory strength.

(g) curve ($F_2$-$G_2$); a circular arc having a radius $R_8$ and a center of the arc $O_8$ located on a straight line ($O_2$-$F_2$) and outside the concave of the groove. The arc circumscribes the arc ($E_2$-$F_2$) at the point $F_2$ and circumscribes a circular arc having a radius equal to the outer diameter of the female rotor at a point $G_2$.

(h) curve ($G_2$-$H_2$); a circular arc having a radius the same as the outer diameter of the female rotor and has a length from 0.01 to 0.004 times PCD of the male rotor.

(2) Male Rotor Tooth Profile (i) Trailing side curve; from an innermost point to the tip, (j) curve ($H_1$-$A_1$); a line generated by a point $H_2$ located on the female rotor tooth profile. The line connects with an arc of the male rotor tooth bottom land at a point $H_1$.

(k) curve ($A_1$-$B_1$); an envelope generated by an arc ($A_2$-$B_2$) which is a part of the female rotor tooth profile. The envelope connects with a curve ($B_1$-$C_1$) at a point $B_1$.

(l) curve ($B_1$-$C_1$); a circular arc having a short radius $R_4$ and a center of the arc $O_4$ located on a radial line (3-$C_1$) extending from the center of the male rotor and intersecting the line (3-4) at a point 3 with an angle $\theta_{r5}$. The angle $\theta_{r5}$ is between 4° and 8° and is relatively large. For this reason, the center of the arc $O_4$ is distant from the line (3-4). The arc connects with a curve ($C_1$-$D_1$) at a point $C_1$.

(m) curve ($C_1$-$D_1$); a circular arc having a point 3 as the center of the arc and a radius $R_5$. The arc ($C_1$-$D_1$) connects with a the curve ($D_1$-$E_1$) at a point $D_1$.

(ii) Leading side curve; from the tip to an innermost point, (n) curve ($D_1$-$E_1$); an envelope generated by the arc ($D_2$-$E_2$) which is a part of the female rotor tooth profile (can be approximated by ($D'_2$-$E_2$)). The envelope connects with a curve ($E_1$-$F_1$) at a point $E_1$. The envelope contacts with the arc ($D'_2$-$E_2$) of the female rotor tooth profile at the point $D'_2$.

(o) curve ($E_1$-$F_1$); an envelope generated by the arc ($E_2$-$F_2$) which is a part of the female rotor tooth profile. The envelope connects with a curve ($F_1$-$G_1$) at a point $F_1$.

(p) curve ($F_1$-$G_1$); an envelope generated by the arc ($F_2$-$G_2$) which is a part of the female rotor tooth profile. The envelope connects with an arc of the rotor bottom land at a point $G_1$.

(q) curve ($G_1$-$H_1$); an arc forming the male rotor bottom land.

Advantages:

Due to the above characteristics of the tooth profiles of the screw rotors of the present invention, the following effects are obtained.

Figure 5:
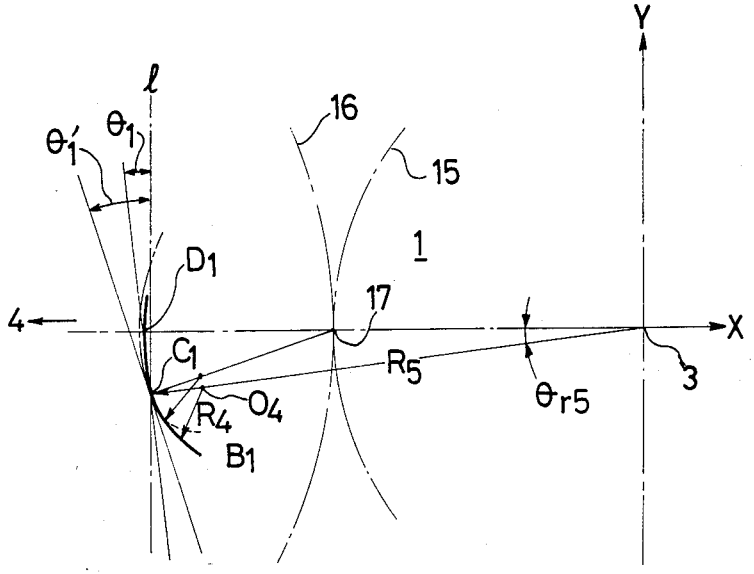
FIGS. 5 to 10 are enlarged views of parts of the tooth profiles in order to explain the characteristic features of the tooth profile curves of the screw rotors according to the present invention.

(1) Since the center $O_4$ of the arc ($B_1$-$C_1$) having the radius $R_4$ is located on the radial line (3-$C_1$) extending from the rotating center 3 of the male rotor, referring to FIG. 5, the angle $\theta_1$ formed between a line tangent to the arc ($B_1$-$C_1$) at the point $C_1$ and a line l perpendicular to the line (3-4) at the point $C_1$ can be set to be smaller than an angle $\theta'_1$ which is formed in the same manner when the center $O_4$ is located on the radial line extending from the pitch point 17. In addition, the trailing side tooth profile of the male rotor is largely separated from the line (3-4) connecting the rotating centers of the two rotors and approaches the female rotor trailing side tooth profile curve. The space 18 can therefore be decreased.

(2) Since the angle $\theta_{r5}$ is set to be relatively large, the center $O_4$ of the arc ($B_1$-$C_1$) located on the extension of radial line (3-$C_1$) which is intersecting the line (3-4) with the angle $\theta_{r5}$ is largely distant from the line (3-4). Therefore, the space 18 can further be decreased.

As can be seen from FIGS. 4(*b*) and 4(*c*), since the volume expansion ratio of the space 18 is small, the power loss due to the vacuum formation is small. Further, in the tooth profiles shown in FIG. 2(*a*), gas and lubricating fluid trapped in the space 73 which appeared in the leading side of the male rotor are overcompressed due to the decrease of the volume of the space 73 upon rotation of the rotors when the output port is closed immediately before the end of the output stroke.

According to the present invention, a space 75 which corresponds to the space 73 may appear as shown in FIGS. 4(*c*) and 4(*d*) during the compression stroke. However, since the curve ($B_1$-$C_1$) of the male rotor tooth profile is a circular arc having the radius $R_4$ and the center of the arc $O_4$ on the line (3-$C_1$) intersecting at the point 3 with the line (3-4) at the angle $\theta_{r5}$ of 4°–8° and the center of the arc $O_4$ is distant from the line (3-4), and further, the curve ($C'_2$-$D'_2$) of the female rotor tooth profile is the common tangent of the envelope ($B_2$-$C_2$) developed by the arc ($B_1$-$C_1$) which is a part of the male rotor tooth profile and the arc ($D'_2$-$E_1$) having the radius $R_1$ or the circular arc having the radius $R_5$ and the curve ($D_1$-$E_1$) of the male rotor tooth profile is the envelope developed by the arc ($D'_2$-$E_2$) which is a part of the female rotor tooth profile, the sealed volume of the space 75 can be minimized. In addition, the space 75 is communicated with the input side of the working space due to the separation of the portions of the envelope of the male and female rotors from each other upon rotation of the rotors, and the appearance of the space 75 is practically ineffective for the performance of the compressor.

As stated heretofore, when the outlet port is closed immediately before the end of the output stroke, the compressed gas and lubricating fluid are not trapped inside the space 75. Accordingly, overcompression of gas and liquid which accompanies noise and abnormal vibration can be prevented. In addition, a bypass hole (see reference numeral 71 in FIG. 2(*b*)) described in Japanese Patent Application Laid Open Gazette Nos. 58-214693 and 58-131383 need not be formed. The present invention can thus provide a simple and inexpensive compressor.

(3) Since the curve ($B_2$-$C_2$), the curve ($D_1$-$E_1$), the curve ($E_1$-$F_1$), the curve ($F_1$-$G_1$) and the curve ($A_1$-$B_1$) are the envelopes developed by the arc ($B_1$-$C_1$), the arc ($D_2$-$E_2$), the arc ($E_2$-$F_2$), the arc ($F_2$-$G_2$) and the arc ($A_2$-$B_2$), respectively, the sliding surfaces of the teeth provide surface contact and will not wear.

Figure 6:
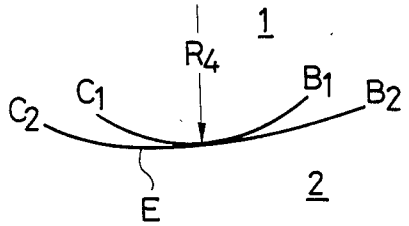

(4) Referring to FIG. 6, since the sliding surfaces of the teeth provide surface contact, when a lubricating fluid E is supplied, lubricating and sealing effects can be improved by the wedging effect.

In this manner, the wear resistance and the seal can be improved, and a lowering of efficiency after the use of screw rotors over a long period of time can be prevented.

Figure 7:
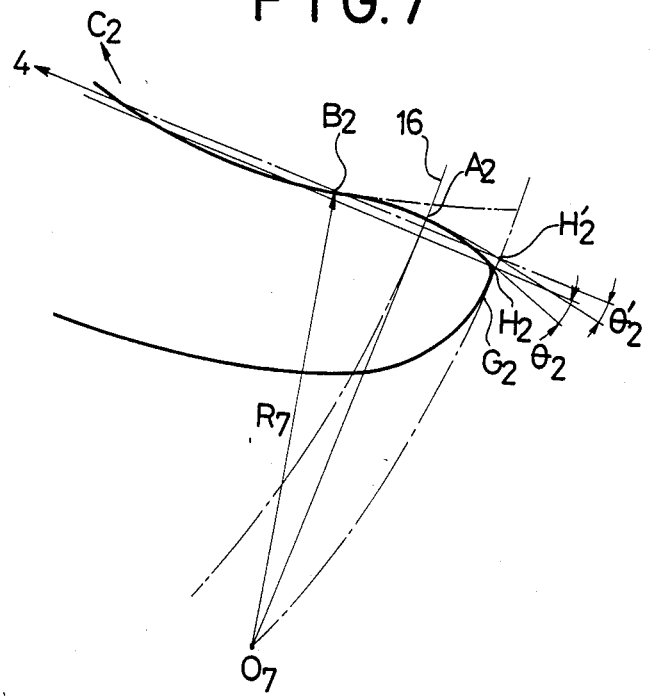

(5) Referring to FIG. 7, since the curve ($A_2$-$B_2$) is the circular arc having the center of the arc $O_7$ outside the concave of the groove of the female rotor, as compared to a tooth profile wherein the curve ($B_2$-$C_2$) is extended to a circle having a radius equal to the outer diameter (4-$H'_2$) or a line connecting the center 4 and the point $B_2$ to the circle having a radius equal to the outer diameter, the bottom of the profile of a cutter cutting the tooth profile of the rotors tends to be widened, and the pressure angle can be increased. Therefore, machining precision of the teeth is improved, and the tool life can be extended.

(6) Since the curve ($H_2$-$A_2$) is a curve generated by the point $A_1$ located on the male rotor tooth profile curve, the pressure angle $\theta_2$ can be set to be larger than the pressure angle $\theta'_2$ which is obtained when the curve ($A_2$-$B_2$) is extended to the circle having a radius equal to the outer diameter (4-$H'_2$). Therefore, the machining precision of the teeth can be improved, and the tool life can be prolonged.

(7) Referring to FIG. 8, the curve ($D_2$-$E_2$) is the circular arc having the center of the arc $O_1$ located outside the pitch circle 16 of the female rotor, the pressure angle $\theta_3$ at the point $E_2$ can be set to be larger than the pressure angle $\theta'_3$ which is obtained when the center of the arc ($D_2$-$E_2$) is located at the pitch point 17, and the pressure angle of the tooth profile constituting the arc ($D_2$-$E_2$) can be set to be large.

(8) Referring to FIG. 9, since the curve ($E_2$-$F_2$) is the circular arc having the center of the arc $O_2$ located on the extension of line ($O_1$-$E_2$) and opposite to the center $O_1$ the arc ($D_2$-$E_2$) with respect to the point $E_2$, as compared with the case wherein the center of the arc ($E_2$-$F_2$) is located at a point $O_2$ at the same side with the center $O_1$ of the arc ($D_2$-$E_2$), the pressure angle $\theta_4$ at the point $F_2$ on the tooth profile can be set to be large ($\angle\theta_4 > \angle\theta'_4$) and the pressure angle of the curve constituting the curve ($E_2$-$F_2$) can be set to be large. Therefore, the damage to the side surface of the hob cutter during hobbing of the rotors can be prevented, the tool life can be prolonged, and the machining precision of the rotors can thus be improved.

Figure 10:
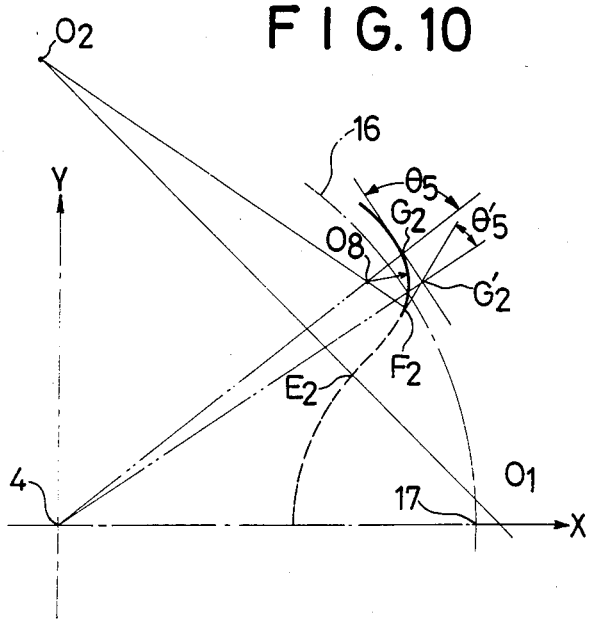

(9) Referring to FIG. 10, since the curve ($F_2$-$G_2$) is the circular arc having the center of the arc $O_8$ located outside the concave of the groove of the female rotor, as compared to the case wherein the arc ($E_2$-$F_2$) is directly extended to a point $G'_2$ located on the circle having the radius equivalent to the outer diameter instead of forming the curve ($F_2$-$G_2$), the pressure angle $\theta_5$ at the point $G_2$ on the tooth profile curve can be set to be large ($\angle\theta_5 > \angle\theta'_5$) and the pressure angle of the curve ($F_2$-$G_2$) can be increased.

(10) Since the addendum Af and the dedendum Dm are incorporated, the space volume between the teeth of the rotor can be increased and the volume of the working space can be significantly increased.

In this manner, the volume of the working space can be increased for increasing the volume of the input air, the pressure angle of the tooth profile can be set to be large, the machining precision of teeth can be improved, and the tool life can be prolonged.

Figure 2A:
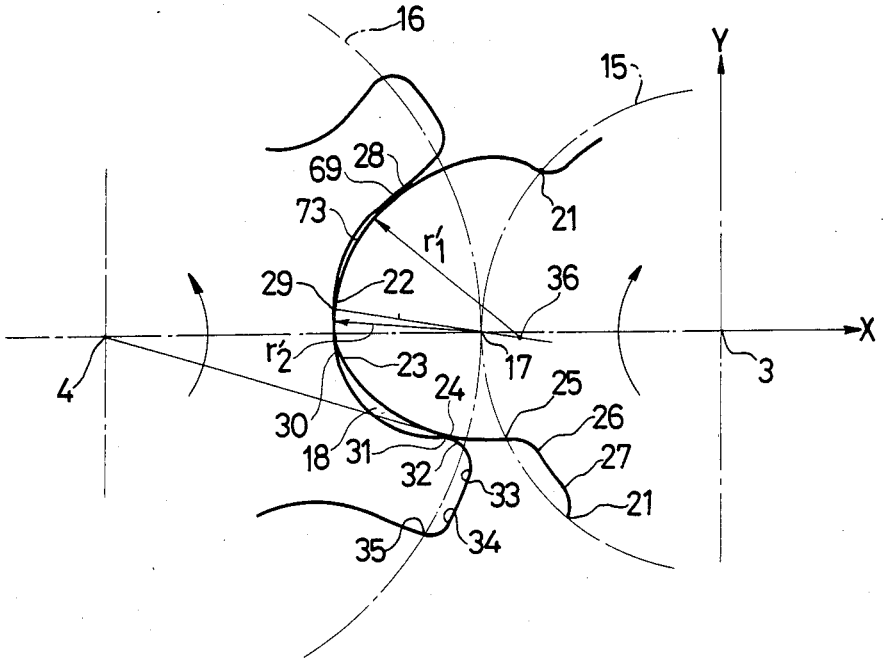
FIG. 2(a) PRIOR ART
FIG. 2(*b*) is a view for explaining a communication path formed in the conventional screw rotor shown in FIG. 2(*a*)
Figure 2B:
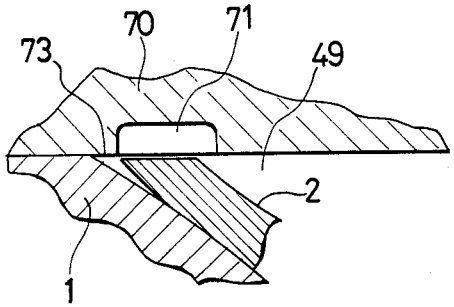
FIG. 2(b) PRIOR ART
Figure 11A:
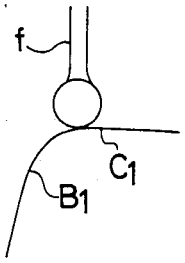
FIGS. 11(*a*)–(*c*) are views for explaining the measuring method of the tooth profiles of the screw rotors according to the present invention.
Figure 11B:
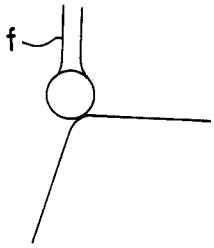
Figure 11C:
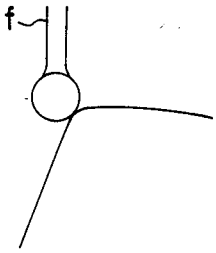
Figure 4D:
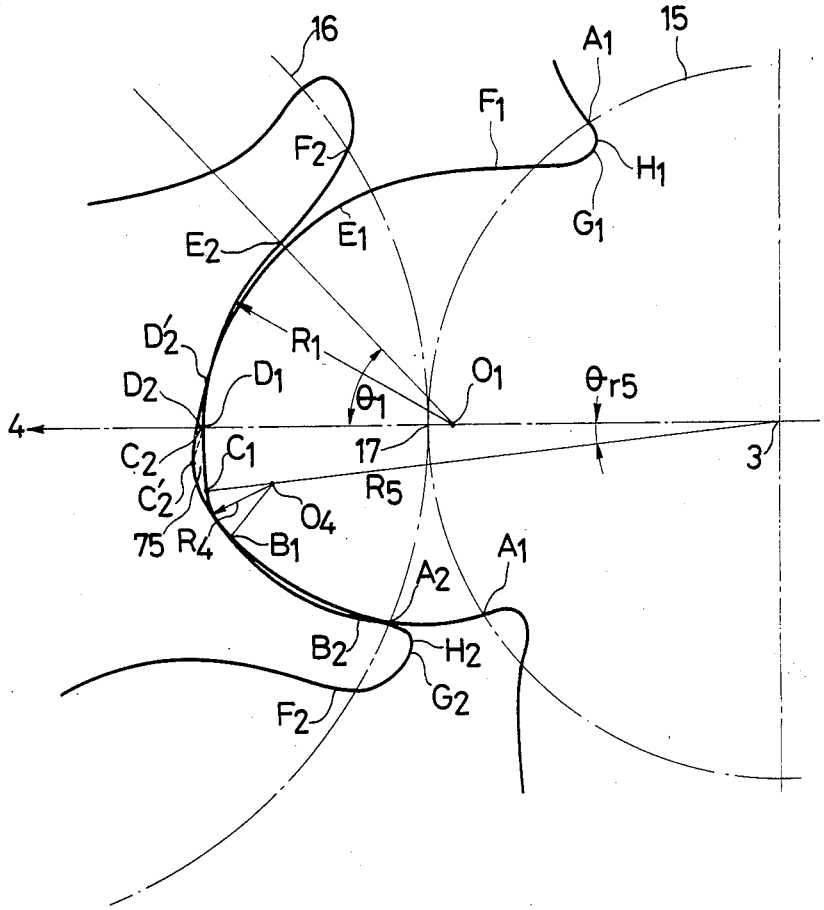

(11) In the conventional tooth profiles, a discontinuous point of the tooth profile at the tip of the male rotor 1 is provided as a sealing point with the tooth profile of the female rotor 2 (see reference numeral 8 in FIG. 1(*b*), and reference numeral 23 in FIG. 2). However, although the sealing point is an important point, since it is a discontinuous point, it cannot be precisely measured by a slide caliper, a micrometer, three-dimensional measurement and the like due to the spherical shape of the tip of a filler f. Referring to FIGS. 11(*b*) and 11(*c*), when the tooth profile has a discontinuous point, even if the same point is measured, the contact point with the filler f is not stable and the correct position of the discontinuous point cannot be determined. In the tooth profile of the present invention, since the sealing point on the rotor 1 is set to a point located on the arc ($B_1$-$C_1$) which is a continuous curve as shown in FIG. 11(*a*), the above problem is resolved and correct measurement can be performed. Accordingly, a correct tooth curve can be easily machined.

According to the tooth profile curves of the present invention, the vacuum producing space is prevented from being large while retaining advantages of the prior art technique. Meanwhile, the tooth profile of the sealing point provides a surface contact between a cylinder and a spherical surface to obtain a wedging effect of a lubricating fluid to achieve efficient sealing and lubrication. The wear of the rotors is reduced, and the sealing with high efficiency are prolonged. The volume of the working space is increased due to incorporation of the addendum Af and the dedendum Dm.

Since the pressure angle near the pitch circle of the tooth profile is set to be relatively large, machining by a tool is easy, and machining precision is improved. In addition, since a cutter need not have a sharp corner, manufacture of the tool is easy and it can be used over a long period of time. The life of a hobbing tool can be prolonged, and hobbing is facilitated. Even though an addendum and a dedendum are incorporated, the blow hole shown in FIG. 4(*a*) is negligible, small.

In summary, the present invention provides screw rotor tooth profiles which allow easy machining, have increased volumes and have excellent durability and efficiency.

The table below shows the radius R and angle $\theta$ at each section of the tooth profile according to the present invention. PCD represents radius of the pitch circle of the male rotor.

TABLE

| | | |
|---|---|---|
| $R_1$ | 0.33–0.4 | PCD |
| $R_2$ | 0.9–1.2 | PCD |
| $R_4$ | 0.05–0.07 | PCD |
| $R_5$ | 0.8–0.85 | PCD |
| $R_7$ | 0.2–0.3 | PCD |
| $\theta_1$ | 40°–46° | |
| $\theta_{r5}$ | 4°–8° | |

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A screw rotor assembly, comprising:

a male rotor (1) having hellical lands and a female rotor (2) having helical grooves which mesh with each other and rotate about two parallel axes, a major portion of each tooth profile of said female rotor being formed inside a pitch circle of said female rotor, and a major portion of each tooth profile of said male rotor being formed outside a pitch circle of said male rotor, wherein in a plane perpendicular to rotating axes of said rotors:

a tooth profile of said female rotor (2) is formed such that a first curve ($H_2$-$A_2$) connecting an outermost point ($H_2$) at a tip of an addendum (Af) and a first point ($A_2$) located on the pitch circle is a generated curve of a second point ($A_1$) located on the pitch circle of the male rotor tooth profile; a portion between said first point ($A_2$) and a third point ($B_2$) is formed by a first circular arc having a first radius ($R_7$) and a center ($O_7$) of said first arc which is located on a line tangent to the pitch circle of the female rotor at said first point ($A_2$) and located outside the concave of the groove; a portion between said second point ($B_2$) and a fourth point ($C'_2$) is formed by a first envelope ($B_2$-$C_2$) developed by a second circular arc ($B_1$-$C_1$) which is a part of the male rotor tooth profile; a portion between fifth and sixth points ($D'_2$) and ($E_2$) is formed by a third circular arc ($D'_2$-$E_2$) having a second radius ($R_1$) and a center ($O_1$) of said third arc is located on a line (3-4) connecting centers of rotation of said male and female rotors and outside the pitch circle of said female rotor; a portion between said fourth and fifth points ($C'_2$) and ($D'_2$) is formed by a common tangent of the first envelope ($B_2$-$C'_2$) and said third circular arc ($D'_2$-$E_2$) and connected with said third arc ($D'_2$-$E_2$) at the fifth point ($D'_2$); a portion between the sixth point ($E_2$) and a seventh point ($F_2$) is formed by a fourth circular arc ($E_2$-$F_2$) connected with the third arc ($D'_2$-$E_2$) at the sixth point ($E_2$) and having a radius ($R_2$) and a center ($O_2$) of a fifth arc located on an extension of a line ($O_1$-$E_2$) intersecting at an angle ($O_1$ ) with said line (3-4) passing through the centers of the rotors and connecting the centers of rotation of said male and female rotors at a position opposite to the center ($O_1$) of the third arc ($D'_2$-$E_2$) with respect to the sixth point ($E_2$); and a portion between the sixth point ($F_2$) and a seventh ($G_2$) is formed by a sixth circular arc ($F_2$-$G_2$) connected with a seventh circular arc ($G_2$-$H_2$) having a radius equal to the outer diameter of said female rotor at an eighth point ($G_2$) and having a radius ($R_8$) and a center ($O_8$) of the arc being located on a line connecting the center ($O_2$) of the fourth arc and the seventh point ($F_2$) and located outside of the groove of the female rotor tooth profile; and a tooth profile of the male rotor (1) is formed such that a second curve ($H_1$-$A_1$) connecting a ninth point ($H_1$) located on a bottom land of a dedendum (Dm) and said second point ($A_1$) located on said pitch circle is a generated curve of a tenth point ($H_2$) located on the female rotor tooth profile, a portion between said second points ($A_1$) and third ($B_1$) is a second envelope developed by an eighth arc ($A_2$-$B_2$) which is a part of the female rotor tooth profile; a portion between an eleventh point ($B_1$) and a twelfth ($C_1$) is formed by a circular arc ($B_1$-$C_1$) connected with said second envelope ($A_1$-$B_1$) at said eleventh point ($B_1$) and having a radius ($R_4$) and a center $O_4$ of the second arc located on a line intersecting at an angle ($\theta_{r5}$) with said line (3-4) connecting the rotating centers (3, 4) of said male and female rotors (1, 2) and located at a predetermined distance from said line (3-4) connecting the rotating centers of said male and female rotors (1, 2); a portion between said twelfth point ($C_1$) and a thirteenth point ($D_1$) is formed by a circular arc ($C_1$-$D_1$) having a radius ($R_5$) and a center of the arc (3) at the rotating center of said male rotor; a portion between the thirteenth point ($D_1$) and a fourteenth point ($E_1$) is formed by a third evelope ($D_1$-$E_1$) developed by a ninth arc ($D_2$-$E_2$) which is a part of the female rotor tooth profile; a portion between the fourteenth point ($E_1$) and a fifteenth point ($F_1$) is formed by a fourth envelope ($E_1$-$F_1$) developed by a tenth arc ($E_2$-$F_2$) which is a part of the female rotor tooth profile; a portion between the points ($F_1$) and $G_1$) is formed by a fifth envelope ($F_1$-$G_1$) developed by the arc ($F_2$-$G_2$); and tooth profiles of said male and female rotors (1, 2) are formed by smoothly and tangentially connecting said arcs and curves.

* * * * *